US007987670B2

(12) United States Patent
Oda et al.

(10) Patent No.: US 7,987,670 B2
(45) Date of Patent: Aug. 2, 2011

(54) EXTERNAL COMBUSTION ENGINE

(75) Inventors: Shuzo Oda, Kariya (JP); Shinichi Yatsuzuka, Nagoya (JP); Yasunori Niiyama, Kuwana (JP); Takashi Kaneko, Nagoya (JP)

(73) Assignee: Denso Corporation, Kariya (JP)

( * ) Notice: Subject to any disclaimer, the term of this patent is extended or adjusted under 35 U.S.C. 154(b) by 409 days.

(21) Appl. No.: 12/321,122

(22) Filed: Jan. 15, 2009

(65) Prior Publication Data

US 2009/0223223 A1 Sep. 10, 2009

(30) Foreign Application Priority Data

Mar. 6, 2008 (JP) ..... 2008-055881

(51) Int. Cl.
*F01B 1/00* (2006.01)

(52) U.S. Cl. ..... 60/508; 60/39.6; 60/531; 60/670

(58) Field of Classification Search ..... 60/39.6, 60/508, 530–531, 670
See application file for complete search history.

(56) References Cited

U.S. PATENT DOCUMENTS

| | | | | |
|---|---|---|---|---|
| 4,489,553 | A * | 12/1984 | Wheatley et al. | 60/516 |
| 7,073,331 | B2 * | 7/2006 | Oda et al. | 60/508 |
| 7,185,491 | B2 * | 3/2007 | Oda et al. | 60/508 |
| 7,415,824 | B2 * | 8/2008 | Komaki et al. | 60/508 |
| 7,424,802 | B2 * | 9/2008 | Yatsuzuka et al. | 60/508 |
| 7,493,751 | B2 * | 2/2009 | Oda et al. | 60/39.6 |
| 7,493,760 | B2 * | 2/2009 | Oda et al. | 60/508 |
| 2007/0220888 | A1 | 9/2007 | Komaki et al. | |

FOREIGN PATENT DOCUMENTS

| | | |
|---|---|---|
| JP | 58-057014 | 4/1983 |
| JP | 2007-255259 | 10/2007 |

* cited by examiner

*Primary Examiner* — Hoang M Nguyen
(74) *Attorney, Agent, or Firm* — Harness, Dickey & Pierce, PLC

(57) ABSTRACT

In a steam engine having multiple main containers, first and second communication pipes are arranged in parallel to each other for respectively communication an auxiliary container with the main containers. Restricted portions and a first switching device are formed in the first communication pipe. The first communication pipe is closed during a start-up step of a starting operation of the engine, in order to prevent that an excess amount of working fluid may flow back from the auxiliary container to the main containers. As a result, a start-up time can be reduced.

8 Claims, 4 Drawing Sheets

EXTERNAL COMBUSTION ENGINE

CROSS REFERENCE TO RELATED APPLICATION

This application is based on Japanese Patent Application No. 2008-55881, which is filed on Mar. 6, 2008, the disclosure of which is incorporated herein by reference.

FIELD OF THE INVENTION

The present invention relates to an external combustion engine, in which steam is produced from working fluid and the steam is liquefied so as to generate volume change of the working fluid, and displacement of liquid portion for the working fluid is converted into kinetic energy.

BACKGROUND OF THE INVENTION

The external combustion engine of the above type is recently called as a steam engine of a liquid piston type, which is known in the art, for example, as disclosed in Japanese Patent Publication No. 2007-255259. According to such a known steam engine, working fluid of liquid condition is charged into a pipe-shaped main container and the working fluid is movable in the main container. A portion of the working fluid is heated by a heating portion, which is provided at one end of the main container, to vaporize the working fluid. Vaporized working fluid (steam of the working fluid) is then cooled down by a cooling portion, which is provided at an intermediate portion of the main container, to condense the steam to the liquefied working fluid. The liquid portion of the working fluid is periodically displaced (so-called, self-excited vibration) by alternately repeating the vaporization and condensation of the working fluid, so that kinetic energy is taken out from the self-vibration for the liquid portion of the working fluid at an output portion communicated to the other end of the main container.

According to the above steam engine, working fluid is also charged into an auxiliary container, which is a separate container from the main container, and the main container and the auxiliary container are communicated with each other through a restricted portion. According to such a structure, inside pressure of the main container is adjusted by use of the auxiliary container, in order to improve output and efficiency of the external combustion engine.

FIG. 3 is a schematic view showing an outline structure of an external combustion engine (a steam engine). The steam engine of FIG. 3 is shown in this application as a reference example, for the purpose of explaining not the prior art but the present invention. In other words, the steam engine does not belong to a prior art.

In FIG. 3, multiple (three) main containers 12 to 14 are connected to one output portion 21. Namely, an external combustion engine is shown as a liquid-piston type steam engine having multiple cylinders.

According to the reference example, a phase of the movement of the working fluid 11 differs from each other among the multiple main containers 12 to 14, so that mechanical vibration at the output portion 21 is reduced.

According to the reference example, the working fluid 11 is charged in a casing 29 of the output portion 21, a casing 29 is communicated with the main containers 12 to 14 through a first communication pipe 33, and restricted portions 35 are formed in the first communication pipe 33. According to such a structure, the casing 29 demonstrates a function of the auxiliary container, as disclosed in the above publication (No. 2007-255259).

Since the working fluid 11 is also charged in the casing 29, air in the casing 29 is prevented from flowing into the main containers 12 to 14 through minute gaps between pistons 22 to 24 and cylinders 25 to 27 of the output portion 21.

Furthermore, according to the reference example, the casing 29 is communicated with the main containers 12 to 14 through a second communication pipe 34, which is arranged in parallel to the first communication pipe 33, and the second communication pipe 34 is opened or closed by a valve 38.

FIG. 4 is a time chart showing an operation of the engine at its starting period according to the above reference example. The starting period is divided into two steps, one is a motoring step and the other is a start-up step. In the motoring step, the pistons 22 to 24 are driven by an outside driving power for one cycle. In the start-up step, the output (the rotational speed) is increased to a predetermined output value (a predetermined rotational speed), after the motoring step has ended. When the start-up step is finished, the steady state operation starts, during which the predetermined output (electrical power) can be taken out from the engine 10.

A certain amount of the working fluid 11 in the main containers 12 to 14 is drained off to the casing 29 through the second communication pipe 34 by opening the valve 38 during the motoring step. So-called liquid-drain-off is carried out.

When the above liquid-drain-off is carried out, the working fluid 11 returns from the main containers 12 to 14 to the casing 29. However, an excessive amount (an amount more than necessary) of the working fluid 11 may return to the casing 29 during the liquid-drain-off process. Then, the working fluid 11 gradually flows back into the main containers 12 to 14 through the restricted portions 35 after the liquid-drain-off. As a result, the liquid amount of the working fluid 11 in the main containers 12 to 14 becomes to an adequate amount. When the liquid amount of the working fluid 11 in all of the main containers 12 to 14 has become to the adequate amount, the starting operation is finished and changed to a steady state operation.

However, as seen from FIG. 4, according to the above reference example, a time necessary for the start-up step (the start-up time) becomes longer, because the phase of the movements in the main containers 12 to 14 differs from each other. As a result, it is a problem in that heat loss during the start-up step may become larger.

We could make a flow passage area of the restricted portions 35 larger, as one of counter measures for the above problem. However, according to such countermeasure, in the main container, in which the operational phase is in the most advanced condition, the working fluid 11 may excessively flow into the main container. After all, the start-up time may become longer even in such a countermeasure.

SUMMARY OF THE INVENTION

The present invention is made in view of the above problems. It is an object of the present invention to provide an external combustion engine having multiple main containers, according to which a time for a start-up step can be reduced.

According to the invention, an external combustion engine has the following features;

- working fluid of liquid condition is charged in multiple pipe-shaped main containers;
- heating portions are respectively formed at one end of the respective main containers, each of the heating portions having a heating device for heating a part of the working fluid in the main containers to produce steam of the working fluid;

cooling portions are respectively formed at the one end of the respective main containers but at a lower position than the respective heating portions, each of the cooling portions having a cooling device for cooling down the steam to condense and liquefy the same to its liquid condition;

an output portion is connected to the other end of the respective main containers for converting movement of liquid portion of the working fluid into kinetic energy, wherein the liquid portion of the working fluid is moved in the main containers in accordance with volume change of the working fluid caused by production and condensation of the steam;

an auxiliary container is further provided, in which working fluid identical to the working fluid charged in the main containers is charged;

first and second communication pipes are arranged in parallel to each other and respectively communicated with the main containers at one end and with the auxiliary container at the other end;

a restricted portion is formed in the first communication pipe;

a first switching device is provided in the first communication pipe for opening or closing the same; and a second switching device is provided in the second communication pipe for opening or closing the same.

The external combustion engine further has a control unit for controlling operations for the heating and cooling devices and the first and second switching devices, in the following manner;

operational phases for movement of liquid portion of the working fluid in the respective main containers differ from each other, during a starting operation, the first switching device is operated to close the first communication pipe, and the second switching device is operated to open the second communication pipe, and during a steady state operation following the starting operation, the first switching device is operated to open the first communication pipe, and the second switching device is operated to close the second communication pipe.

According to the above structure and operation of the invention, the first communication pipe is closed at least one time during the starting operation. Therefore, an excess amount of the working fluid is prevented from flowing from the auxiliary container to the main container, in which the operational phase is in the most advanced condition, even when the flow passage area of the restricted portion is made larger. As a result, a time for start-up step of the starting operation can be made shorter.

According to a further feature of the invention, during the starting operation, a time period for closing the first communication pipe by the first switching device is the same to a time period for opening the second communication pipe by the second switching device.

According to such an operation, an excess amount of the working fluid is effectively prevented from flowing to the main container, in which the operational phase is in the most advanced condition. Therefore, the start-up time can be effectively reduced.

According to a further feature of the invention, the first switching device and the second switching device are composed of a three-way valve provided in the first communication pipe and the second communication pipe.

Accordingly, the first and second switching devices can be formed in a simpler manner.

According to a further feature of the invention, the first communication pipe comprises a collecting pipe portion and branch pipe portions respectively connected to the main containers, and the first switching device comprises multiple switching means respectively provided in the branch pipe portions.

According to a further feature of the invention, the output portion has pistons movable upon receiving fluid pressure from the liquid portion of the working fluid, cylinders for movably accommodating the piston, and a casing, in which the working fluid is charged, and which is communicated with the main containers through the cylinders. In such an external combustion engine, the auxiliary container is formed by the casing, and the casing and the main containers are communicated with each other through the first and second communication pipes.

According to such a structure, the auxiliary container is integrally formed in the output portion so that the external combustion engine can be made in a simpler manner.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
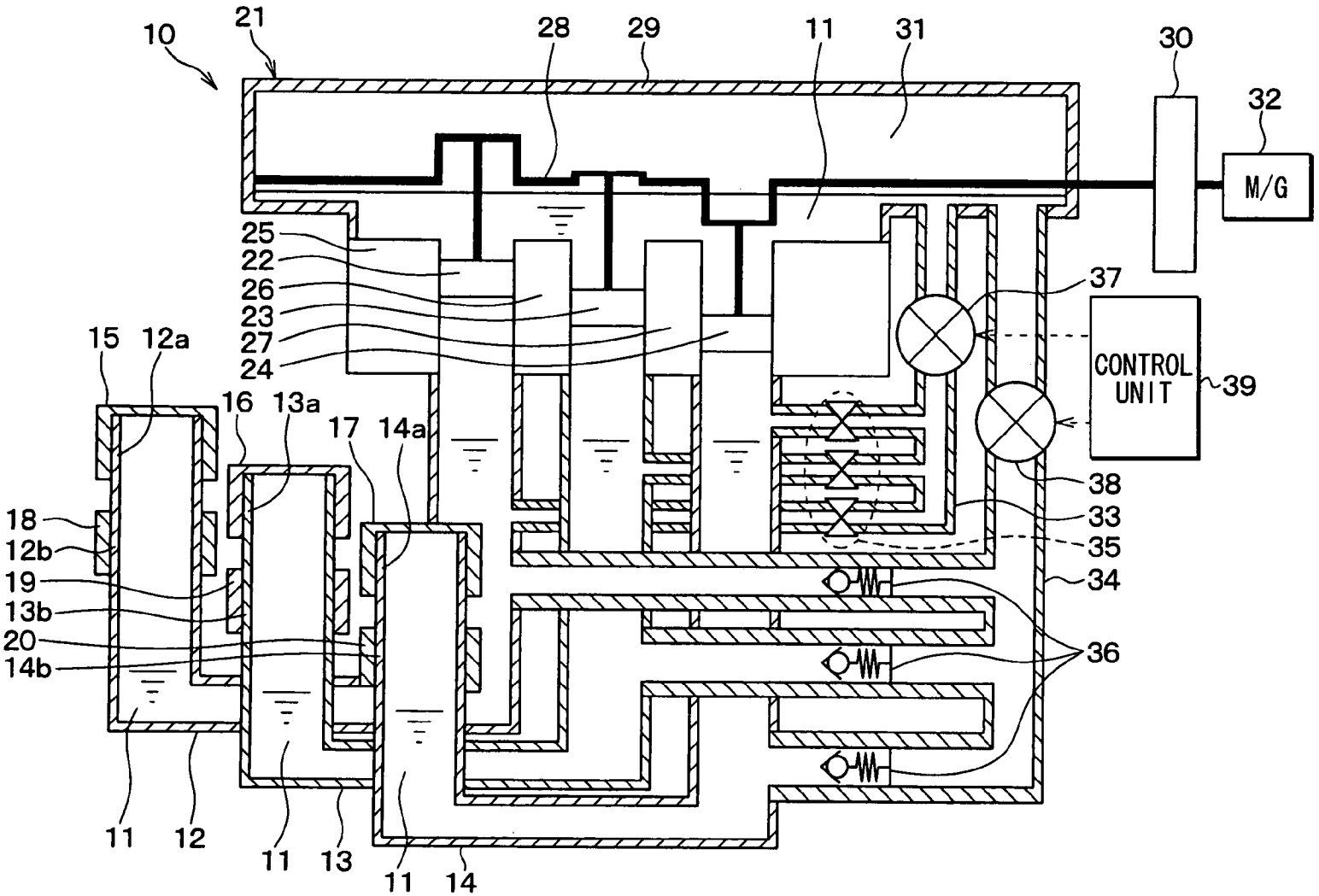
FIG. 1 is a schematic view showing an outline structure of an external combustion engine according to an embodiment of the present invention.

The present invention will be hereinafter explained with reference to an embodiment, in which an external combustion engine of the present invention is applied to a driving source for an electrical power generating device. FIG. 1 is a schematic view showing an outline structure of the external combustion engine according to the embodiment of the present invention.

An external combustion engine 10 (a steam engine of a liquid piston type) has multiple (three in this embodiment) pipe-shaped main containers 12, 13 and 14, in which working fluid 11 of liquid condition is charged as being movable. The engine 10 further has multiple heating devices 15, 16 and 17 for heating and vaporizing the working fluid 11 in the main containers 12, 13 and 14, multiple cooling devices 18, 19 and 20 for cooling down steam produced by vaporizing the working fluid 11, and an output portion 21 at which kinetic energy is taken out. Although water is used as the working fluid 11 in the embodiment, any other material, for example refrigerant, may be used.

Each of the main containers 12, 13 and 14 is formed into a U-letter shape, a bent portion of which is arranged at a lowermost position and both end portions of which are arranged to extend in an upward direction. At one end of each U-shaped main containers 12, 13 and 14, each one of the heating devices 15, 16 and 17 and cooling devices 18, 19 and 20 are so arranged that the heating device (15, 16, 17) is positioned at an upper side of the cooling device (18, 19, 20).

According to the embodiment, high temperature gas, for example exhaust gas of a vehicle, is supplied to the heating devices 15 to 17, whereas cooling water is supplied to the cooling devices 18 to 20. The cooling water is circulated through the cooling devices 18 to 20 and through a heat exchanger (not shown), so that heat absorbed from the steam of the working fluid 11 at the cooling devices 18 to 20 is radiated to the outside. As above, the heat exchanger (not shown) is provided in a circuit for the cooling water.

Heating portions 12*a*, 13*a* and 14*a* of the main containers 12 to 14, which are in contact with the heating devices 15 to 17, as well as cooling portions 12*b*, 13*b* and 14*b* of the main containers 12 to 14, which are in contact with the cooling devices 18 to 20, are preferably made of such material having high thermal conductivity. According to the embodiment, the heating portions 12*a* to 14*a* as well as the cooling portions 12*b* to 14*b* are made of copper or aluminum.

The heating devices 15 to 17 may be integrally formed with the heating portions 12*a* to 14*a*, and the cooling devices 18 to 20 may be also integrally formed with the cooling portions 12*b* to 14*b*.

Other portions of the main containers 12 to 14 than the heating and cooling portions 12*a* to 14*a* and 12*b* to 14*b* may be preferably made of such material having high heat insulation efficiency. In the embodiment, stainless steel is used in consideration that the water is used as the working fluid 11.

A space (although not indicated by reference numerals) having a certain volume is formed at an upper side of each heating portion 12*a* to 14*a* of the main containers 12 to 14, for ensuring a room for vaporizing the working fluid 11. Gas (for example, air) of the certain volume is charged into the space.

Each of the other ends of the main containers 12 to 14 is communicated with the output portion 21. The output portion 21 has pistons 22, 23 and 24, each of which is displaced upon receiving pressure from liquid portion of the working fluid 11, cylinders 25, 26 and 27 for respectively and movably supporting the pistons 22 to 24, a crank 28 linked with the pistons 22 to 24, a casing 29 for rotatably supporting the crank 28, and a flywheel 30 connected to the crank 28, wherein a certain amount of the working fluid 11 is also charged in the casing 29.

The casing 29 has a function of an auxiliary container for adjusting average pressure of inside pressures of the main containers 12 to 14 (hereinafter also referred to as main container average pressure). The inside space of the casing 29 is communicated with the main containers 12 to 14 through the cylinders 25 to 27. A lower part (a lower inside space) of the casing 29 is filled with the working fluid 11 of the liquid condition, whereas an upper part (an upper inside space) of the casing 29 is filled with gas 31.

Gas, which is hardly soluble into the working fluid 11, may be preferably used as the gas 31. For example, helium gas (which is hardly soluble into water) is used as the gas 31 in the embodiment. The casing 29 (the whole inside space of the casing 29) may be filled with only the working fluid of the liquid condition.

The casing 29 may be preferably made of such a material having high heat insulation efficiency. In the embodiment, stainless steel is used in consideration that the water is used as the working fluid 11.

A pressure regulating device (not shown) is provided at the casing 29 for regulating inside pressure of the casing 29 (hereinafter also referred to as casing inside pressure). The pressure regulating device may be composed of, for example, a pressure regulating piston for regulating inside volume of the casing 29 and an electrically operated actuator for driving the pressure regulating piston.

The crank 28 is connected to a motor-generator 32, which has a function for generating electrical power by output (rotational force of the crank 28) from the output portion 21 in case of a normal operation, as explained below. The motor-generator 32 also has a function as a starter motor, which is driven by electrical power supplied from an outside power supply device (not shown) at starting an operation of the engine 10.

The casing 29 is also communicated with the main containers 12 to 14 through first and second communication pipes 33 and 34, which are arranged in parallel to each other. Each of the first and second communication pipes 33 and 34 is formed by a collecting pipe portion on a side of the casing 29 and branch pipe portions respectively branched off from the collecting pipe portion at one ends and communicated to the main containers 12 to 14 at the other ends. The first and second communication pipes 33 and 34 may be preferably made of such material having high heat insulation efficiency. In the embodiment, stainless steel is used because the water is used as the working fluid 11.

A restricted portion 35 is formed in each of the branch pipe portions of the first communication pipe 33, wherein the restricted portion 35 stabilizes the casing inside pressure (the pressure in the casing 29) at a pressure almost equal to the main container average pressure. According to the embodiment, a fixed orifice (in which a passage portion is made smaller) is used as the restricted portion 35. The restricted portion 35 may be provided a tone portion of the collecting pipe portion of the first communication pipe 33.

A passage area of the second communication pipe 34 is made larger than a passage area of the restricted portion 35. Check valves 36 are respectively provided in each of the branch pipe portions of the second communication pipe 34, in order to allow fluid flow of the working fluid 11 from the main containers 12 to 14 to the casing 29 but to prohibit the fluid flow from the casing 29 to the main containers 12 to 14.

According to the embodiment, a spring-type check valve having a spring is used as the check valve 36, wherein the check valve 36 is opened when the fluid pressure of the main containers 12 to 14 is higher than that of the casing 29.

A first valve 37 is provided in the collecting pipe portion of the first communication pipe 33 for opening or closing the same. And in a similar manner to the first valve 37, a second valve 38 is provided in the collecting pipe portion of the second communication pipe 34 for opening or closing the same.

An operation of the first and second valves 37 and 38 is controlled by an electronic control unit (ECU) 39, which is composed of a well known microcomputer having CPU, ROM, RAM etc, and peripheral circuits and devices.

Various kinds of detected signals from sensors are inputted to the ECU 39, for example, a signal from a temperature sensor (not shown) for detecting temperature at the heating portions 12*a* to 14*a*, a signal from a temperature sensor (not shown) for detecting temperature at the cooling portions 12*b* to 14*b*, a signal from a pressure sensor (not shown) for detecting pressure in the inside of the casing 29 and so on. The ECU 39 drives and controls the electrically operated actuator of the pressure regulating device in accordance with such detected signals from the sensors.

An operation of the above structured engine 10, namely a steady state operation and a starting operation of the engine 10, will be respectively explained. At first, the steady state operation will be explained. When the heating devices 15 to 17 as well as the cooling devices 18 to 20 are operated, the working fluid (water) 11 in the heating portions 12*a* to 14*a* is heated so that the working fluid is vaporized. Then, high-temperature and high-pressure steam of the working fluid 11 is accumulated in the spaces of the heating portions 12*a* to 14*a* to push down the liquid surface of the working fluid 11.

The liquid portion of the working fluid 11 is displaced in the main containers 12 to 14, from the heating portions 12*a* to 14*a* to the output portion 21, to push up the pistons 22 to 24 of the output portion 21. As a result, the crank 28 and the flywheel 30 are driven to rotate.

When the liquid surface of the working fluid is moved downwardly to the cooling portions 12*b* to 14*b*, and thereby the steam of the working fluid 11 comes into spaces of the cooling portions 12*b* to 14*b*, the steam is cooled down by the cooling devices 18 to 20. Then, the steam is condensed (liquefied) and the pressure for pushing down the liquid surface of the working fluid 11 disappears (or will be decreased).

As a result, the pistons 22 to 24 of the output portion 21, which are lifted up by the expansion of the steam of the working fluid 11, will be pushed back (namely, pushed down) by inertia force of the flywheel 30. When the pistons 22 to 24 are moved downwardly, the liquid portion of the working fluid 11 is displaced in the main containers 12 to 14 in a reversed direction, namely from the output portion 21 to the heating portions 12*a* to 14*a*, to move the liquid surface of the working fluid 11 to the heating portions 12*a* to 14*a*.

The above movements are repeatedly carried out until the operation for the heating devices 15 to 17 and the cooling devices 18 to 20 is stopped. During the above movements, the liquid portion of the working fluid 11 is periodically displaced (moved as the self-excited vibration) to drive the pistons 22 to 24 up and down to rotate the crank 28.

Figure 2:
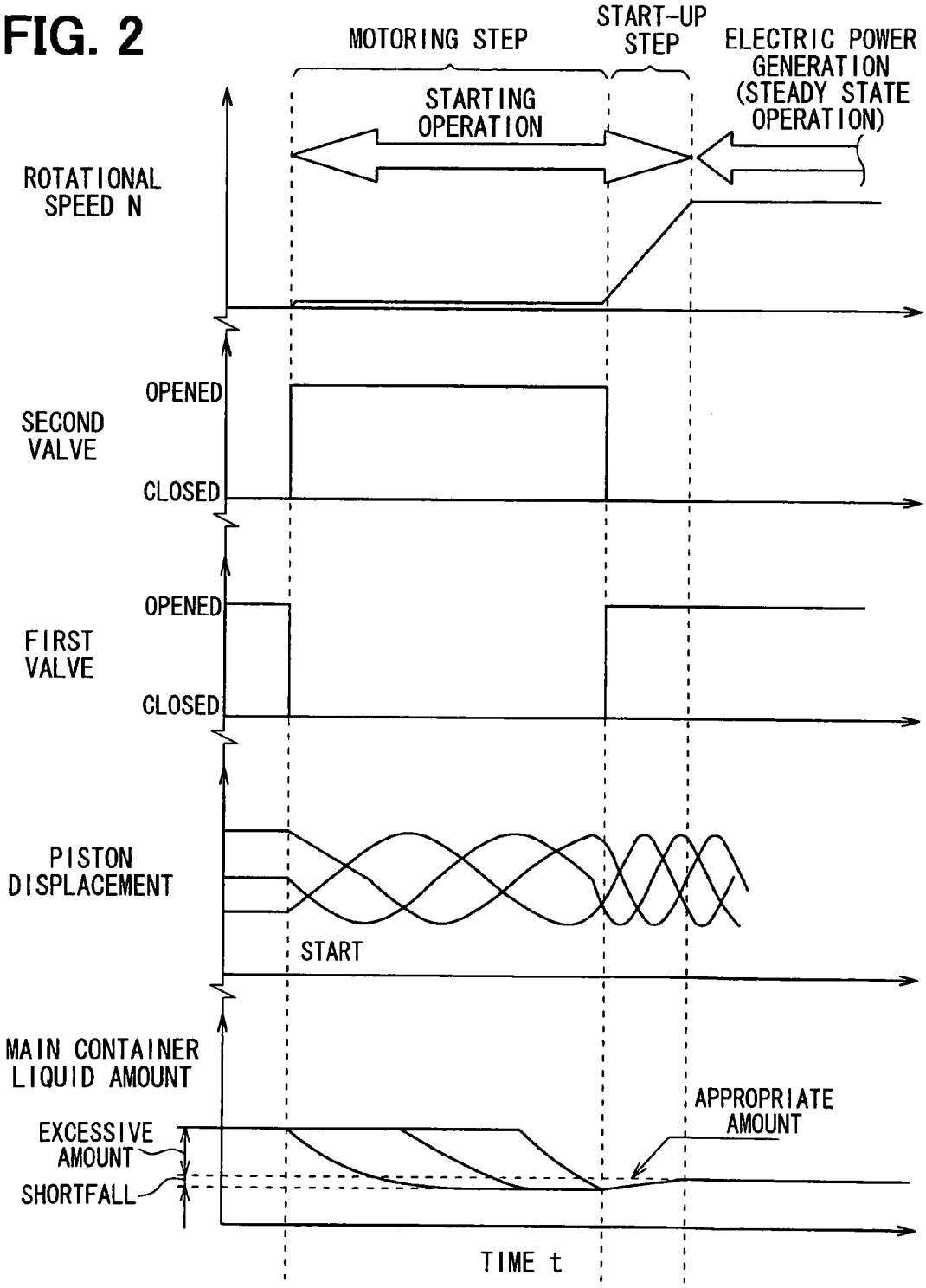
FIG. 2 is a time chart showing an operation of the engine at its starting period according to the above embodiment.
Figure 3:
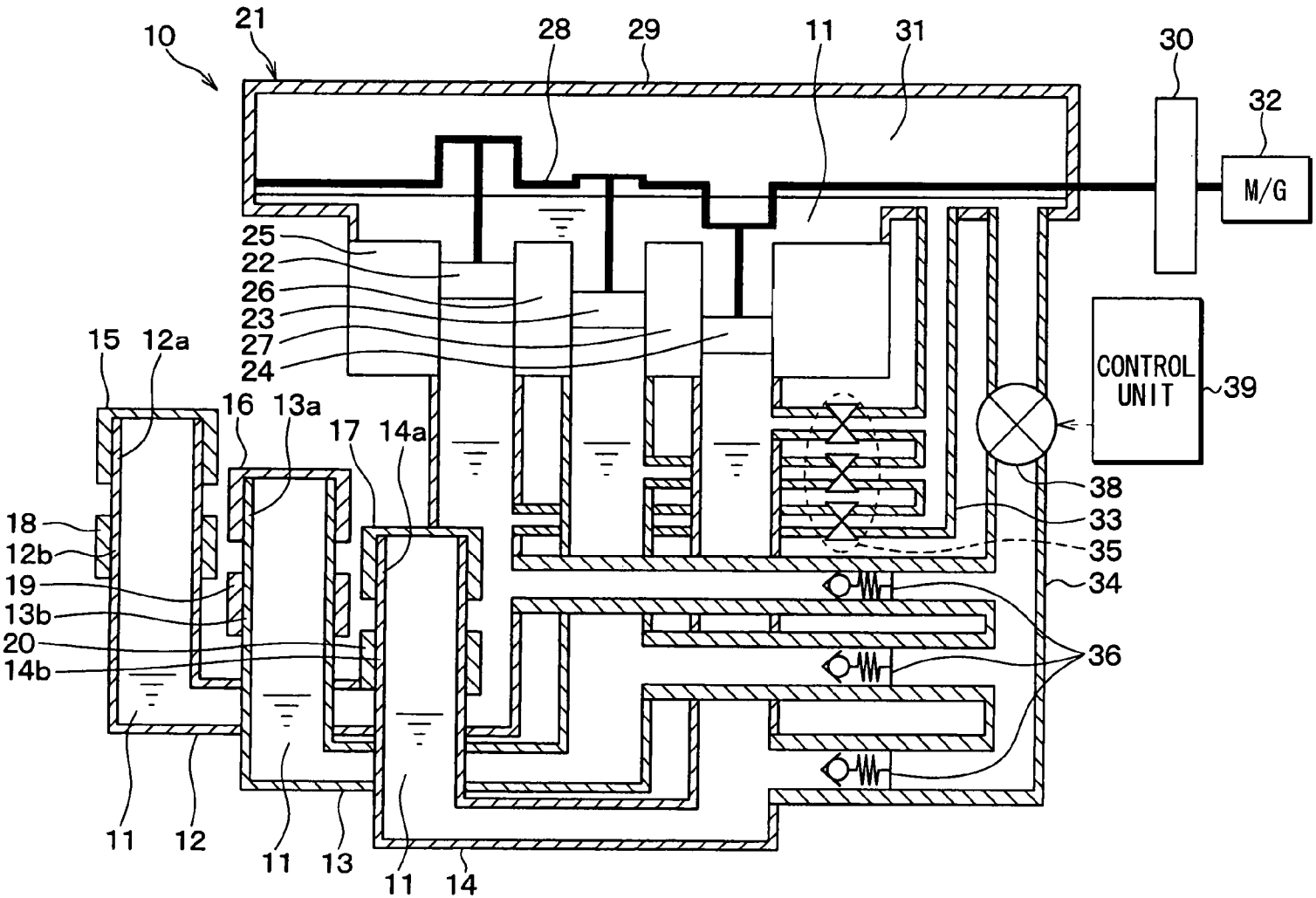
FIG. 3 is a schematic view showing an outline structure of an external combustion engine according to a reference example.

As shown in FIG. 2 (explained below more in detail), a phase of the self-excited vibration of the working fluid 11 differs from each other among the multiple main containers 12 to 14, so that mechanical vibration at the output portion 21 is reduced.

As explained above, the working fluid 11 is also charged in the casing 29. Accordingly, air in the casing 29 is prevented from flowing into the main containers 12 to 14 through minute gaps between the pistons 22 to 24 and the cylinders 25 to 27, during the up and down movements of the pistons 22 to 24.

The ECU 39 controls the main container average pressure during the steady state operation. As the above-mentioned publication (Japanese Patent Publication No. 2007-255259) discloses detailed operation for controlling the main container average pressure, only a brief explanation is made here.

At first, the ECU 39 calculates a saturated vapor pressure of the working fluid 11 at temperature of the heating portions (also referred to as heating portion temperature), based on the heating portion temperature as well as a vapor pressure curve for the working fluid 11 memorized in advance in the ECU 39. In a similar manner, the ECU 39 calculates a saturated vapor pressure of the working fluid 11 at temperature of the cooling portions (also referred to as cooling portion temperature), based on the cooling portion temperature as well as the vapor pressure curve for the working fluid 11.

Then, the ECU 39 calculates an average amount between the saturated vapor pressure of the working fluid 11 at the heating portion temperature and the saturated vapor pressure of the working fluid 11 at the cooling portion temperature. This average amount is set as a target value for the main container average pressure.

As the saturated vapor pressure of the working fluid 11 at the cooling portion temperature becomes almost equal to the atmospheric pressure (0.1 MPa), an average amount between the saturated vapor pressure of the working fluid 11 at the heating portion temperature and the atmospheric pressure (0.1 MPa) may be set as the target value for the main container average pressure. Furthermore, any modified amount for the above average amounts may be used as the target value.

When the casing inside pressure is lower than the target value for the main container average pressure, the electrically operated actuator of the pressure regulating device pushes out the pressure regulating piston thereof to reduce a capacity of the casing 29, so that the working fluid 11 in the casing 29 is compressed to increase the casing inside pressure.

On the other hand, when the casing inside pressure is higher than the target value for the main container average pressure, the pressure regulating piston is pulled back to increase the capacity of the casing 29, so that the working fluid 11 in the casing 29 is expanded to decrease the casing inside pressure.

Then, the main container average pressure follows the change of the casing inside pressure, so that the main container average pressure is controlled at the target value for the main container average pressure. As above, the main container average pressure is controlled at the target value, even when the heating portion temperature is changed. A decrease of performance (i.e. the output and efficiency) to be caused by the change of the heating portion temperature is prevented.

Now, explanation for the starting operation will be made with reference to FIG. 2. FIG. 2 is a time chart showing the operation of the engine at its starting period. The starting period is divided into two steps, one is a motoring step and the other is a start-up step. In the motoring step, the pistons 22 to 24 are driven by an outside driving power for one cycle. In the start-up step, the output (the rotational speed "N") is increased to a predetermined output value (a predetermined rotational speed), after the motoring step has ended. When the start-up step is finished, the steady state operation starts, during which the predetermined output (electrical power) can be taken out from the engine 10.

During the starting operation, liquid amount of the working fluid 11 in the main containers 12 to 14 (also referred to as main container liquid amount) is in an excess condition. Such an excessive amount of the main container liquid amount is drained off to the casing 29 in the motoring step (it is called as liquid-drain-off).

A reason why the main container liquid amount is in the excess condition will be briefly explained here. When the operation of the external combustion engine 10 is terminated, the steam of the working fluid 11 is condensed and liquefied in accordance with the decrease of the heating portion temperature. Then, the inside pressure of the main containers 12 to 14 (also referred to as main container inside pressure) is decreased, so that the working fluid 11 of the liquid condition in the casing 29 starts to flow into the main containers 12 to 14 through the restricted portions 35.

In addition, the working fluid 11 in the casing 29 gradually flows into the main containers 12 to 14 through the minute gaps between the pistons 22 to 24 and the cylinders 25 to 27. As a result, the main container liquid amount is in the excess condition at the starting operation of the engine 10.

In the motoring step, the motor-generator 32 is operated by an outside power supply source so as to drive the pistons 22 to 24 to rotate by one cycle. Therefore, each of the pistons 22 to 24 respectively passes through its bottom dead center by one time during the motoring step. In the motoring step, the first valve 37 is closed and the second valve 38 is opened by the ECU 39.

When the pistons 22 to 24 are moved from the top dead center toward the bottom dead center, the working fluid 11 in the main containers 12 to 14 is compressed to thereby increase the main container pressure. During such an operation, the pressure regulating piston is moved to such a position, at which the capacity of the casing 29 becomes maximum, so as to make the casing inside pressure at a minimum value.

The main container inside pressure becomes higher than the casing inside pressure, to thereby open the check valves 36 of the second communication pipe 34. As a result, the working fluid of the liquid condition in the main containers 12 to 14 flows into the casing 29 through the check valves 36 and the second valve 38. As above, the excessive amount of the main container liquid amount is drained off to the casing 29.

In the above motoring step, an operating frequency of the motor generator 32 is made smaller than that for the steady state operation, by increasing an outside load for the motor generator 32.

Accordingly, moving speed of the pistons 22 to 24 becomes lower in the motoring step, and flow speed of the working fluid 11 flowing through the second communication pipe 34 becomes correspondingly lower. A pressure drop in the second communication pipe 34 is thereby made smaller.

According to the embodiment, the pressure drop in the second communication pipe 34 is made smaller than the saturated vapor pressure at the heating portion temperature. As a result, the excessive amount of the working fluid 11 can be quickly drained off from the main containers 12 to 14 to the casing 29.

The flow passage area of the second communication pipe 34 may be made larger, or the length of the second communication pipe 34 may be made shorter, in order that the pressure drop in the second communication pipe 34 is made smaller than the saturated vapor pressure at the heating portion temperature.

The liquid-drain-off is thus carried out, when the pistons 22 to 24 pass through the bottom dead centers. As shown in FIG. 2, a small amount of the working fluid 11 may additionally flow from the main containers 12 to 14 to the casing 29, when the liquid-drain-off is carried out. As a result, the liquid amount in the main containers comes short by a small amount.

In the case that the first valve 37 was not provided in the first communication pipe 33, as in a similar manner to the above explained reference example, the working fluid 11 of the casing 29 could gradually flow into the main containers 12 to 14 through the restricted portions 35. Furthermore, a shortfall of the main container liquid amount would return to the main containers 12 to 14, so that the main container liquid amount would become at an adequate amount.

Figure 4:
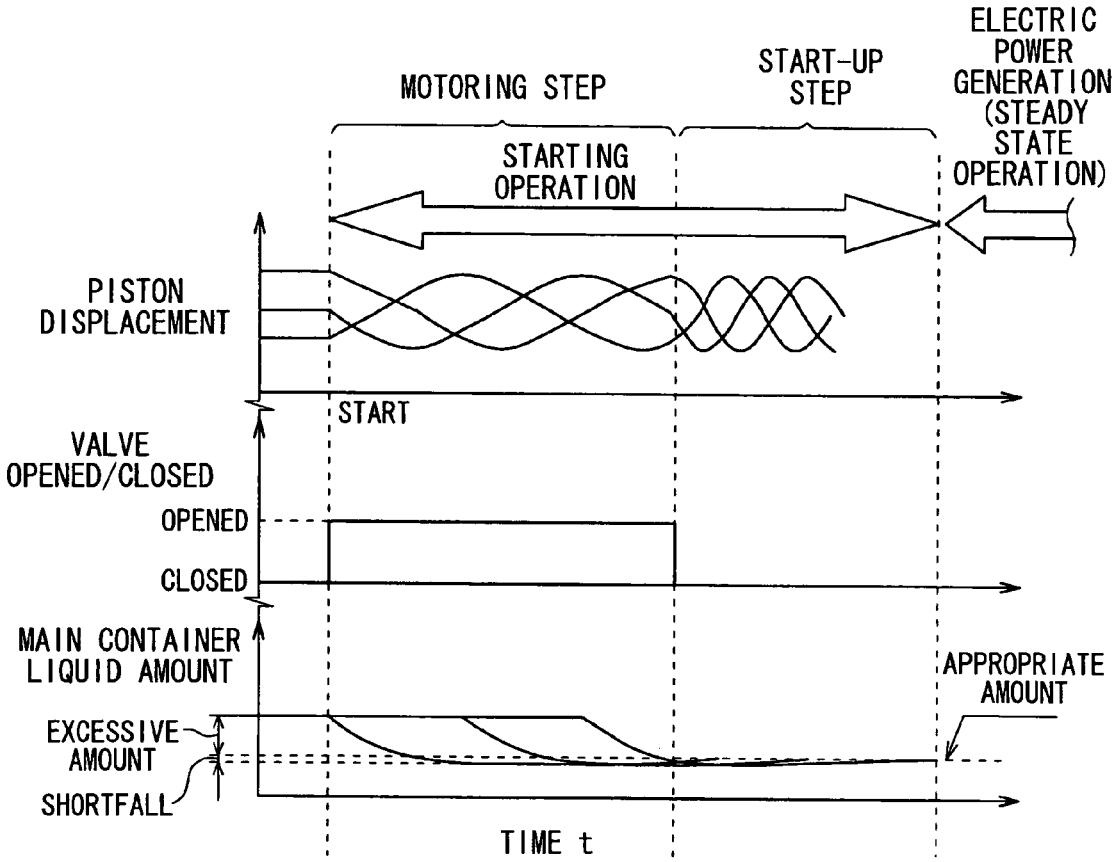
FIG. 4 is a time chart showing an operation of the engine at its starting period according to the above reference example.

However, as understood from FIG. 4 for the reference example, a time at which the main container liquid amount becomes at the adequate amount differs from container to container, because the operational phase differs from each other.

Accordingly, in the main container (12, 13 or 14) in which the operational phase is in the most advanced condition, the main container liquid amount will become at the adequate amount at such a time, which is almost the same time at which the motoring step will be ended. On the other hand, in the main container (12, 13 or 14) in which the operational phase is in the most delayed condition, a further certain time will pass from the end of the motoring step, until the main container liquid amount will become at the adequate amount.

According to the above reference example, therefore, a time necessary for the start-up step (also referred to as start-up time) would become longer, and thereby heat loss during the starting operation would be larger.

As a countermeasure for the above problem, we could make the flow passage area of the restricted portions 35 larger. According to such an arrangement, the flow amount flowing from the casing 29 into the main containers 12 to 14 through the restricted portions 35 could be increased, and thereby the main container liquid amount could be made to the adequate amount in a shorter time period.

However, according to the above countermeasure, in the main container (12, 13 or 14) in which the operational phase is in the most advanced condition, the working fluid 11 may be excessively returned from the casing 29 to the main container. Then, the main container liquid amount may become to the excess condition again.

When the main container liquid amount would become too excessive, a desired output could not be obtained. As a result, the start-up time may become longer.

According to the present embodiment, the above explained disadvantages are taken into consideration. The flow passage area of the restricted portions 35 is made larger and at the same time the first valve 37 is provided in the first communication pipe 33, in order to make shorter the start-up time.

More in detail, the first valve 37 is closed during the motoring step. Therefore, in the main container (12, 13 or 14) in which the operational phase is in the most advanced condition, the excess amount of the working fluid 11 is prevented from returning from the casing 29 into the main container.

The first valve 37 is opened when the motoring step is finished. Accordingly, the working fluid 11 of the casing 29 can smoothly flow into the main containers 12 to 14 through the restricted portions 35. As a result, the main container liquid amount can quickly reach at its adequate amount.

Accordingly, the start-up time can be reduced, to thereby decrease the heat loss during the starting operation.

The second valve 38 is closed, when the motoring step is finished. Therefore, the working fluid 11 may not flow into the casing 29 through the second communication pipe 34, even when the check valves 36 are opened during the start-up step or the steady state operation.

Furthermore, such a situation may be avoided, in which the working fluid 11 may flow from the main containers 12 to 14 into the casing 29 through the second communication pipe 34 during the steady state operation, and thereby the main container liquid amount may become smaller than the adequate amount. Accordingly, a decrease of performance of the external combustion engine 10 can be prevented.

Other Embodiments

In the above embodiment, the timings for opening or closing the first and second valves 37 and 38 are explained as an example. It is possible to change the opening and/or closing timings for the first and second valves 37 and 38 in the backward or forward to some extent.

In the above embodiment, the first valve 37 is provided in the first communication pipe 33, whereas the second valve 38 is provided in the second communication pipe 34. A three-way valve may be provided at the first and second communication pipes 33 and 34, in stead of the first and second valves 37 and 38. According to such an arrangement, a structure for the first and second switching means for opening and closing the first and second communication pipes 33 and 34 may be constructed in a simpler manner.

In the above embodiment, the first switching means for opening and closing the first communication pipe 33 is formed by the first valve 37. However, when the restricted portion 35 is composed of an electrically controlled variable restriction device, the function for opening and closing the pipe 37 by the first valve 37 may be carried out such electrically controlled variable restriction device.

In the above embodiment, the casing 29 has a function for the auxiliary container, which is disclosed in the publication (Japanese Patent Publication No. 2007-255259), so that the auxiliary container is integrally formed in the output portion 21. However, such auxiliary container may be formed as a separate device from the output portion 21, as in the same manner to the above publication.

In the above embodiment, the pressure regulating device is provided at the casing 29 so as to adjust the main container average pressure. The pressure regulating device may not be necessarily provided. In other words, the main container average pressure may not be necessarily controlled.

In the above embodiment, each of the main containers 12 to 14 is formed by a single pipe structure. However, one end of the pipe may be composed of multiple branch pipe portions, so that the heating portions (12*a* to 14*a*) are formed at such branch pipe portions. And the other end of the pipe may be made of one collecting pipe portion.

In the above embodiment, the present invention is applied to the electrical power generating device. However, the external combustion engine of the present invention may be applied to any other driving sources than the electrical power generating device.

What is claimed is:

1. An external combustion engine comprising:

multiple pipe-shaped main containers, in which working fluid of liquid condition is charged;

heating portions respectively formed at one end of the respective main containers, each of the heating portions having a heating device for heating a part of the working fluid in the main containers to produce steam of the working fluid;

cooling portions respectively formed at the one end of the respective main containers but at a lower position than the respective heating portions, each of the cooling portions having a cooling device for cooling down the steam to condense and liquefy the same to its liquid condition;

an output portion connected to the other end of the respective main containers for converting movement of liquid portion of the working fluid into kinetic energy, wherein the liquid portion of the working fluid is moved in the main containers in accordance with volume change of the working fluid caused by production and condensation of the steam;

an auxiliary container, in which working fluid identical to the working fluid charged in the main containers is charged;

first and second communication pipes arranged in parallel to each other and respectively communicated with the main containers at one end and with the auxiliary container at the other end;

a restricted portion formed in the first communication pipe;

a first switching device provided in the first communication pipe for opening or closing the same;

a second switching device provided in the second communication pipe for opening or closing the same; and a control unit for controlling operations for the heating and cooling devices and the first and second switching devices, in such a way that operational phases for movement of liquid portion of the working fluid in the respective main containers differ from each other, during a starting operation, the first switching device is operated to close the first communication pipe, and the second switching device is operated to open the second communication pipe, and during a steady state operation following the starting operation, the first switching device is operated to open the first communication pipe, and the second switching device is operated to close the second communication pipe.

2. The external combustion engine according to the claim 1, wherein during the starting operation, a time period for closing the first communication pipe by the first switching device is the same to a time period for opening the second communication pipe by the second switching device.

3. The external combustion engine according to the claim 2, wherein the first switching device and the second switching device are composed of a three-way valve provided in the first communication pipe and the second communication pipe.

4. The external combustion engine according to the claim 1, wherein the first communication pipe comprises a collecting pipe portion and branch pipe portions respectively connected to the main containers, and the first switching device comprises multiple switching means respectively provided in the branch pipe portions.

5. The external combustion engine according to the claim 1, wherein the output portion comprises:

pistons movable upon receiving fluid pressure from the liquid portion of the working fluid;

cylinders for movably accommodating the piston;

a casing, in which the working fluid is charged, and which is communicated with the main containers through the cylinders, the auxiliary container is formed by the casing, and the casing and the main containers are communicated with each other through the first and second communication pipes.

6. An external combustion engine comprising:

an output portion having a casing in which working fluid is charged, multiple cylinders, and a crank rotatably supported by the casing;

multiple pistons movably accommodated in the respective cylinders and operatively linked with the crank so that a reciprocal movement of the pistons is converted to a rotational movement of the crank;

multiple pipe-shaped main containers, each of which is bent into a U-letter shape, each one end of which is respectively connected to the cylinders, and in which working fluid of liquid condition is charged;

multiple heating portions respectively formed at the other end of the respective main containers, each of the heating portions having a heating device for heating a part of the working fluid in the main containers to produce steam of the working fluid;

multiple cooling portions respectively formed at the other end of the respective main containers but at lower positions than the respective heating portions, each of the cooling portions having a cooling device for cooling down the steam to condense and liquefy the same to its liquid condition;

a first communication pipe having a collecting pipe portion communicated with the casing and branch pipe portions respectively communicated with the main containers;

multiple restricted portion respectively formed in the branch pipe portions of the first communication pipe;

a first switching device provided in the collecting pipe portion of the first communication pipe for opening or closing the same;

a second communication pipe having a collecting pipe portion communicated with the casing and branch pipe portions respectively communicated with the main containers;

multiple check valves respectively formed in the branch pipe portions of the second communication pipe;

a second switching device provided in the collecting pipe portion of the second communication pipe for opening or closing the same;

a control unit for controlling operations for the heating and cooling devices and the first and second switching devices, in such a way that operational phases for movement of liquid portion of the working fluid in the respective main containers differ from each other, during a starting operation, the first switching device is operated to close the first communication pipe, and the second switching device is operated to open the second communication pipe, and during a steady state operation following the starting operation, the first switching device is operated to open the first communication pipe, and the second switching device is operated to close the second communication pipe.

7. The external combustion engine according to the claim 6, further comprising:

a flywheel connected to the crank.

8. The external combustion engine according to the claim 6, further comprising:

a motor-generator connected to the crank, which drives the crank to rotate the same at least by one operational cycle of the pistons during a starting operation of the engine.

* * * * *